US011363369B2

(12) United States Patent
Siig

(10) Patent No.: US 11,363,369 B2
(45) Date of Patent: Jun. 14, 2022

(54) AUDIO LOUDSPEAKER SYSTEM

(71) Applicant: Ellegaarden R&D ApS, Frederiksvaerk (DK)

(72) Inventor: Ole Siig, Frederiksvaerk (DK)

(73) Assignee: Ellegaarden R&D ApS, Frederiksvaerk (DK)

( * ) Notice: Subject to any disclaimer, the term of this patent is extended or adjusted under 35 U.S.C. 154(b) by 0 days.

(21) Appl. No.: 17/272,328

(22) PCT Filed: Aug. 29, 2019

(86) PCT No.: PCT/EP2019/073085
§ 371 (c)(1),
(2) Date: Feb. 28, 2021

(87) PCT Pub. No.: WO2020/052985
PCT Pub. Date: Mar. 19, 2020

(65) Prior Publication Data

US 2021/0185430 A1 Jun. 17, 2021

(30) Foreign Application Priority Data

Sep. 10, 2018 (EP) ..... 18193485

(51) Int. Cl.
*H04R 1/28* (2006.01)

(52) U.S. Cl.
CPC ..... *H04R 1/28* (2013.01); *H04R 1/2811* (2013.01); *H04R 1/2819* (2013.01)

(58) Field of Classification Search
CPC ..... H04R 1/28
See application file for complete search history.

(56) References Cited

U.S. PATENT DOCUMENTS

2005/0084127 A1* 4/2005 Norton ..... H04R 1/2888 381/338
2010/0232637 A1* 9/2010 Kowaki ..... H04R 1/2896 381/386

FOREIGN PATENT DOCUMENTS

DE 19830947 1/2000
EP 3282714 2/2018

OTHER PUBLICATIONS

International Search Report received in PCT/EP2019/073085, dated Oct. 30, 2019.

(Continued)

*Primary Examiner* — Andrew L Sniezek
(74) *Attorney, Agent, or Firm* — Suzannah K. Sundby, Esq.; Canady + Lortz LLP

(57) ABSTRACT

An audio loudspeaker system for reproducing frequencies between 16 Hz and 700 Hz, comprising a loudspeaker housing defining an inner resonance chamber and at least two loudspeaker drivers arranged in the housing and having front faces arranged facing each other in an opposed manner. The housing comprises vertical wall elements arranged with a distance approximately defining a width of the resonance chamber, where each wall element comprises first and second side surfaces and a circumferential edge surface. A first side surface of the wall elements constitutes and inner surface of the housing and partly defines an enclosure of the resonance chamber, and a second side surface of the wall elements constitutes exterior side surfaces of the audio loudspeaker system. The loudspeaker drivers are arranged within substantially hemispherical cups arranged on the second side surfaces of the wall elements and enclosing the loudspeaker drivers in a close manner.

20 Claims, 8 Drawing Sheets

(56) References Cited

OTHER PUBLICATIONS

Sobaric Subwoofer Design—VUE Audiotechnik, Printed Jul. 3, 2019.
Wilson Benesch Endeavour Loudspeakers—The Audio Beat, Printed Jul. 3, 2019.
Neil Gader, Gallo Acoustics Reference 3.5 Loudspeaker (TAS 209)—The Absolute Sound, Printed Jul. 3, 2019.

* cited by examiner

AUDIO LOUDSPEAKER SYSTEM

The present invention relates to an audio loudspeaker system for reproducing frequencies between 16 Hz and 700 Hz.

Traditionally known loudspeakers for use in home audio systems typically comprise a rectangular enclosure and transducers arranged to direct sound waves towards an intended listening position.

Physics dictate that a large volume of air must be moved precisely to reproduce the lowest frequencies and the dynamic range present in musical performances. Traditionally, in order to create low frequency sounds from a conventional box loudspeaker enclosure to reduce its fundamental resonance frequency, the loudspeaker enclosure needs to incorporate a large volume of air, which leads to loudspeakers becoming large and bulky and often employing acoustic compromises that may trade dynamic clear bass for an extended low frequency response.

Resonances are inherent to musical instruments and define their sound characteristics. However, loudspeaker enclosure vibration and resonances must be avoided, as this unwanted additional sound will add distortion components not found in the programmed material.

However, a problem with traditional large volume loudspeakers is that the transducers dissipate energy into the enclosed volume, causing the enclosure to mechanically vibrate and resonate at various frequencies. The larger the enclosure, the harder it becomes to avoid or dampen mechanical vibration and resonances, especially at the low end of the audible sound spectrum. These mechanical vibrations and resonances are transferred to the room as both direct and reflected sound by the surfaces of the enclosure, creating a mix of additional sound pressure not present in the original signal as sent to the loudspeaker driver and thus causing distortion of the original sound.

DE 19830947 A1 describes a loudspeaker for producing low frequency sounds where two transducers are arranged towards each other and mounted within an enclosure. The mounting of the two opposed transducers causes cancellation of non-linear harmonic and intermodulation distortion of the loudspeaker drivers; however, the surfaces enclosing the opposed transducers, like in traditional speakers, cause serious enclosure vibration and resonances. Further, an issue inherent with this known design is a typical and pronounced resonance peak of at least 10 dB-20 dB at around 180 hz-300 Hz, as determined by enclosure dimension, port opening sizes, and the resulting impedance coupling of the enclosure air volume to the room.

It is therefore an object of the present invention to construct an audio loudspeaker system to almost eliminate enclosure resonances and mechanical vibration at low frequency sounds.

The above object and advantages, together with numerous other objects and advantages, which will be evident from the description of the present invention, are according to the present invention obtained by:

An audio loudspeaker system for reproducing frequencies between 16 Hz and 700 Hz, comprising a loudspeaker housing defining an inner resonance chamber and at least two loudspeaker drivers arranged in the housing and having front faces arranged facing each other in an opposed manner, the housing comprising vertical first and second opposed and parallel wall elements arranged with a distance approximately defining a width of the resonance chamber, where each wall element comprises first and second side surfaces and a circumferential edge surface, where part of said circumferential edge surfaces defines an upper edge surface, a lower edge surface, a front edge surface facing a front of the loudspeaker system, and a rear edge surface facing a rear of the loudspeaker system, the first side surface of the first and the second opposed wall elements constituting an inner surface of the housing and partly defining an enclosure of the resonance chamber, and the second side surfaces of the first and the second wall elements constituting a first and second exterior side surface of the audio loudspeaker system, the housing further comprising a frame structure being arranged between the first and second wall elements and at a peripheral circumference thereof, the frame structure partly defining an enclosure of the resonance chamber, the loudspeaker drivers being arranged on the second side surfaces of the first and the second wall elements, respectively, and the front faces of the loudspeaker drivers facing the resonance chamber and facing each other, the opposed loudspeaker drivers each further comprises a substantially hemispherical cup arranged on the second side surfaces of the first and the second wall elements and enclosing the loudspeaker drivers in a close manner.

By arranging the loudspeaker drivers with two substantially hemispherical cups on the outside surface of the two opposed and parallel wall elements, the total volume of air to compress for a given size of woofer is optimally reduced. This reduction in air volume extends the low frequency response of the bass pump and reduces the excursion of the driver piston required for a given sound pressure level, hereby extending the useful operating frequency range above the typical 180 Hz-300 Hz resonance peak to at least above 370 Hz.

The loudspeaker system thus allows the use of two 8" or 10" long stroke woofers for a performance similar to that of the 12" woofers of the known prior art. Further, arranging the cups with a substantially hemispherical design, creates the least surface area for a given internal volume and thereby also the least structural resonances in any given frequency band.

Apart from the smaller physical size, an advantage of a smaller piston area is lower moving mass, which allows faster acceleration and shifts breakup of the loudspeaker diaphragm into higher frequencies, thus improving phase characteristics and lowering distortion within the operating range of the bass system.

According to a further embodiment of the invention, the substantially hemispherical cups comprise a layered construction having and outer surface layer of e.g. hardwood, ceramic, plastic or the like, and at least one inner layer of sound absorbing material, such as a syntactic foam.

According to a further embodiment of the invention, the hemispherical cups further comprise an intermediate layer between the outer and the inner layer, the intermediate layer comprising a synthetic rubber, such as a butyl rubber.

Arranging the substantially hemispherical cups as a layered construction, also referred to as constraint-layer damping, enhances the damping of enclosure resonance, especially arranging the cups with a hard outer surface, an inner sound absorbing material, and an intermediate layer comprising a synthetic rubber, has according to tests by the inventor, proven to be especially prosperous.

According to a further embodiment of the invention, the sound absorbing material comprises a cement-based syntactic foam.

Studies have found that cement-based syntactic foam has a high acoustic transmission loss at frequencies between 100 Hz-500 Hz and a maximum transmission loss of about 80 dB at about 300 Hz-400 Hz coinciding with the resonance peak of the present invention. When compared to a polymer-based foam core having similar compositions, it was found that the cement-based foam has a comparable energy dissipation capacity, hereby being low frequency resonance absorbing.

Having the inner layer of sound absorbing material made of a cement-based syntactic foam, creates a further damping of any undesired enclosure vibration and resonances.

According to a further embodiment of the invention, the frame structure comprises at least one open port facing said front of said loudspeaker system.

Preferable, the opening area of the front port is approximate ⅓ of the area of a piston of the drivers, and the front port may be comprised of an array of open front ports.

According to a further embodiment of the invention, each of the hemispherical cups comprises at least one open rear port facing the rear of the loudspeaker system.

The location and dimensions of the front and rear ports result in an asymmetric omnidirectional sound dispersion pattern with the sound from the at least one front port and at least one rear port of lower sound pressure level and out of phase with the sound from the at least one front port.

According to a further embodiment of the invention, the open rear port defines an open area of approximate ¼ of the area of a piston of each of said loudspeaker drivers.

Arranging the at least one front opening and at least one rear opening of each cup with the above specified opening area, compared to the area of the driver pistons in combination with minimizing the enclosure volumes, has according to tests performed by the inventor shown a preferred enclosure resonance peak being above 370 Hz, hereby extending the useful operating frequency range compared to the known prior art.

According to a further embodiment of the invention, the opposed loudspeaker drivers are woofers for operating in phase.

Any non-linear distortion from mechanical deformation and vibration of the loudspeaker drivers is substantially eliminated due to the two opposed loudspeaker drivers operating in phase.

According to a further embodiment of the invention, the frame structure extends above the opposed loudspeaker drivers and the frame structure further comprises at least one midrange driver and/or at least one super-tweeter driver, each arranged within a funnel-shaped enclosure, arranged as a spherical support extending into a closed tube-shape and having inner conical shape, extending in the rear direction of the loudspeaker system.

The midrange and super-tweeter loudspeaker units are chosen to blend with the bass system for an overall flat acoustic response. The midrange and super-tweeter enclosures are optimized for minimum diffraction using a substantially funnel-shaped enclosure arranged as a spherical support extending in the rear direction of the loudspeaker system tuned and dampened to further absorb the energy of the speaker driver's back pressure.

The midrange and super-tweeter loudspeaker units are mounted as closely together as possible, which is achieved by recessing the super-tweeter housing into a corresponding groove in the midrange housing, thereby minimizing the lobing that would otherwise occur when the sound waves of the two drivers merge.

According to a further embodiment of the invention, each of the funnel-shaped enclosures comprises a vibration damping material, such as a synthetic or natural wool material.

According to a further possible embodiment, each of the funnel-shaped enclosures is lined with soft, sound absorbing material, such a silicon or rubber, with a texture scattering the back-pressure sound waves, thereby minimizing reflections bouncing back onto the loudspeaker driver diaphragm.

The funnel-shaped enclosures extending in the rear direction of the loudspeaker system comprise a somewhat compacted or dense, preferably synthetic or natural, wool material, hereby damping any undesired enclosure resonance of the funnel-shaped enclosures.

According to a further embodiment of the invention, the vertical first and second opposed and parallel wall elements comprise an acrylic sheet material.

Studies by the inventor have shown that arranging the vertical first and second opposed and parallel wall elements as an acrylic sheet material, preferably a transparent acrylic sheet material, enables the speaker enclosure to be particular low-resonant.

According to a further embodiment of the invention, the loudspeaker system further comprises driver connection means extending through the resonance chamber and arranged for interconnecting the phase plug of each loudspeaker driver. The loudspeaker drivers have driver magnets at a rear end thereof and are connected to the hemispherical cups via fastening means, such as a bolt or screw, etc., extending through the hemispherical cups and into the magnets, hereby arranging the loudspeaker drivers connected and suspended between said hemispherical cups.

Arranging connecting means for physically interconnecting the phase plug of each loudspeaker driver, forms a single mechanical driver system that "floats" suspended between the hemispherical cups. As the driver magnets have a considerably higher mass than a chassis of a loudspeaker driver, substantially all mechanical vibration from the drivers to the housing of the speaker system is eliminated.

According to a further embodiment of the invention, the speaker system comprises an intermediate C-shaped element arranged within the inner resonance chamber between the loudspeaker drivers and at a peripheral circumference of the driver piston, hereby limiting the inner volume of the resonance chamber between the loudspeaker drivers.

Arranging the C-shaped element within the resonance chamber in between the two opposed drivers, maximally limits the total volume of the resonance chamber for a given chamber width and further lowers the frequency response by at least 2 Hz, hereby producing extremely low sounds.

Undesirable transmission of acoustic waves to surrounding structures of a room, especially the floor and walls, is cancelled out within the speaker.

According to a further embodiment of the invention, the frame structure is having the shape of a treble clef.

According to a further embodiment of the invention, the frame structure is having the shape of a bass clef.

The structure of the loudspeaker system may have the shape of any musical symbol or any other shape not representing the shape of a musical symbol.

The invention will now be explained in more detail below by means of examples of embodiments with reference to the very schematic drawing, in which FIG. 1 shows a perspective view of the audio loudspeaker system.

Figure 1:
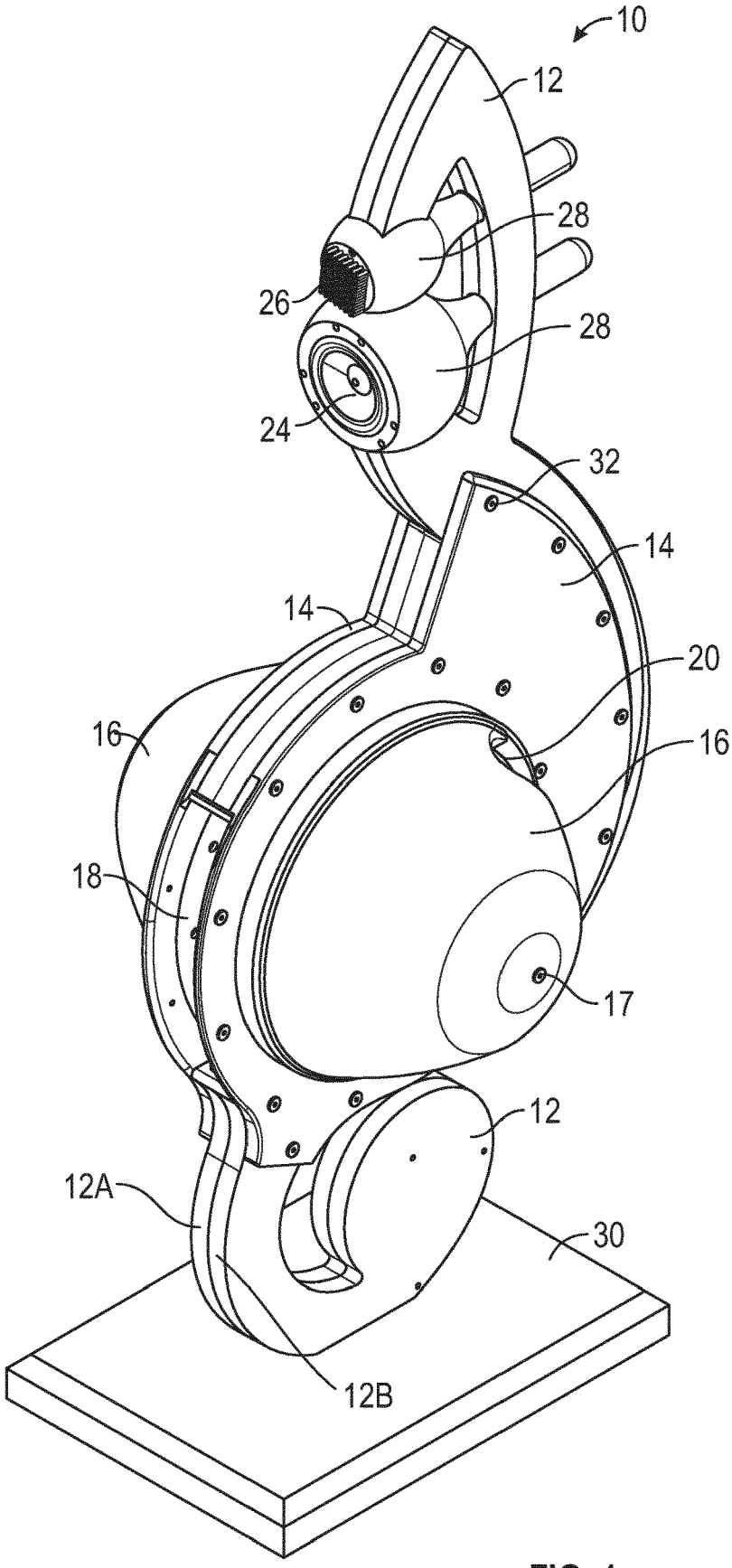

The present invention will now be described more fully hereinafter with reference to the accompanying drawings, in which exemplary embodiments of the invention are shown. The invention may, however, be embodied in different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout. Like elements will, thus, not be described in detail with respect to the description of each figure.

FIG. 1 shows a perspective view of the audio loudspeaker system 10. The loudspeaker system 10 comprises a frame structure 12 arranged on a foot 30 for supporting the loudspeaker system 10 on a floor surface (not shown). The frame structure 12 is illustrated as a structure having the shape of a treble clef. The shape of the structure 12 is however not limited to the shape of a treble clef and could present the shape of any musical symbol or non-musical structure. The frame structure 12 is further illustrated being laminated of first and second frame structure elements (12A,12B) having a surface facing the front of the speaker which is substantially perpendicular to a side surface of the loudspeaker system 10. In an alternative embodiment, the front surface of the frame structure 12 may be narrow-pointed or curved for minimum diffraction of the sound. Further, the frame structure may be formed as a one-piece element instead of being laminated or laminated of multiple pieces. On each side of the frame structure 12 is arranged two opposed wall elements 14 constituting a first and second exterior side surface of the audio loudspeaker system 10. The opposed and parallel wall elements 14 are arranged with a distance to each other on the frame 12 in such a way that the wall elements 14 and the frame structure 12 define a housing, and so that the wall elements constitute and inner surface of the housing and partly define a resonance chamber (not shown) within the housing. The wall elements 14 are fixed to the frame structure 12 by any suitable mounting means 32, such as screws, nails, adhesives, mechanical locking, etc. On each of the first and second side surface of the wall elements 14 is arranged a hemispherical cup 16, where each of the hemispherical cups 16 encloses a loudspeaker driver (not shown) for generating soundwaves, where the loudspeaker drivers are arranged with front faces facing each other in an opposed manner and connected at a rear end to the inside of the hemispherical cups via fastening means 17 such as a bolt. Each of the hemispherical cups 16 comprises a rear port 20 facing the rear of the speaker and preferably having an opening area corresponding to ¼ of the area of the loudspeaker driver piston, and arranged for letting out the air pressure in the cups 16 generated by the moving loudspeaker driver 22. The loudspeaker system further comprises a front port 18 at the front face of the loudspeaker system 10, where the front port 18 is arranged between the opposed wall elements 14 and in connection with the resonance chamber between the loudspeaker drivers 22 (not shown). The frame structure 12 of the loudspeaker system 10 further extends in a vertical direction above the hemispherical cups 16 and comprises a midrange driver 24 and a super-tweeter 26. Each of the midrange driver 24 and the super-tweeter 26 is arranged within a funnel-shaped enclosure 28, where the enclosure 28 is formed as a spherical support extending into a closed tube-shape, extending in the rear direction of the loudspeaker system 10. The midrange driver 24 and the super-tweeter 26 are arranged as closely to each other as possible, the super-tweeter 26 resting in a matching groove formed in the housing of the midrange driver 24.

The loudspeaker system 10 may be constructed without a foot 30. For example, the loudspeaker may alternatively be arranged with a mounting bracket or other suitable means, for mounting the loudspeaker system 10 to a floor, wall or ceiling surface of a room. The foot 30 may house electronics, such as amplifiers, Digital Signal Processing (DSP), interfaces and any other electronics for the loudspeaker system 10 to produce sound from an input signal.

Figure 2:
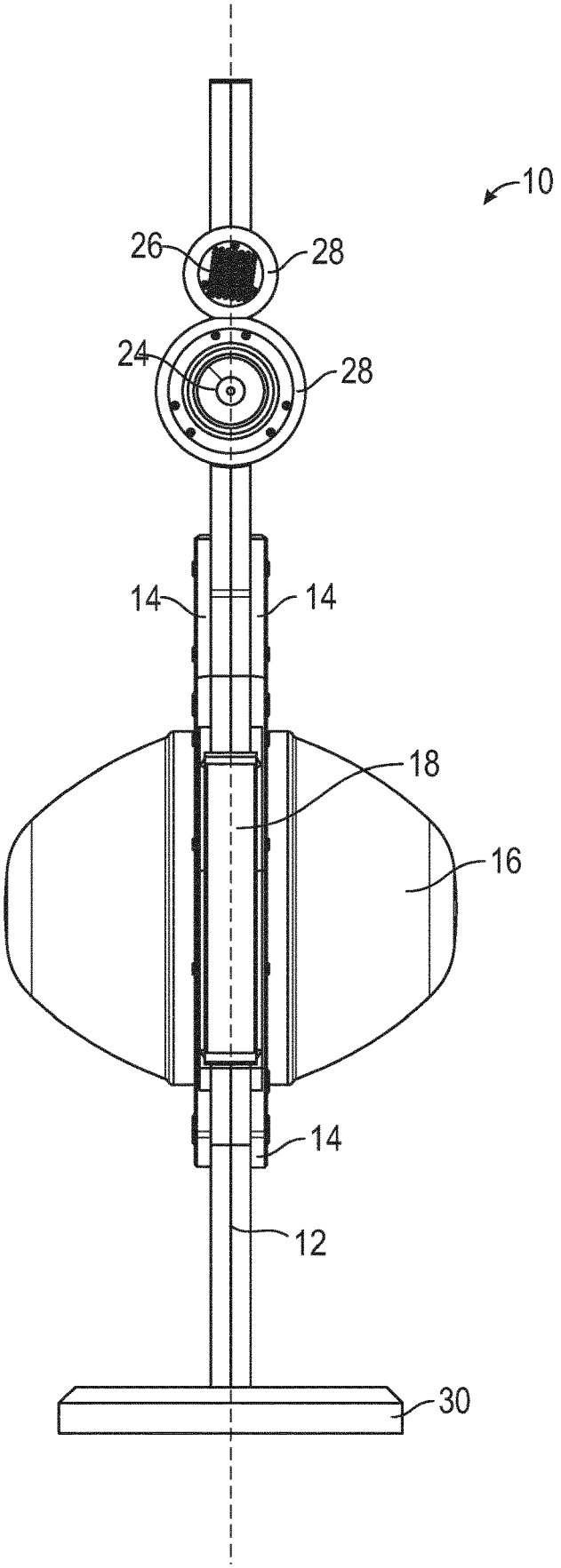
FIG. 2 shows a front view of the speaker system.

FIG. 2 shows a front view of the speaker system. The loudspeaker system is constructed symmetrically on each side of the centreline A-A. The hemispherical shape of the cups 16 on each side of the wall elements 14 is evident from the illustration. The opening area of the front port 18 is illustrated as a single opening in connection with the resonance chamber between the loudspeaker drivers and the front opening 18 spans substantially the extent of the loudspeaker drivers (not shown) in the vertical direction.

Figure 3:
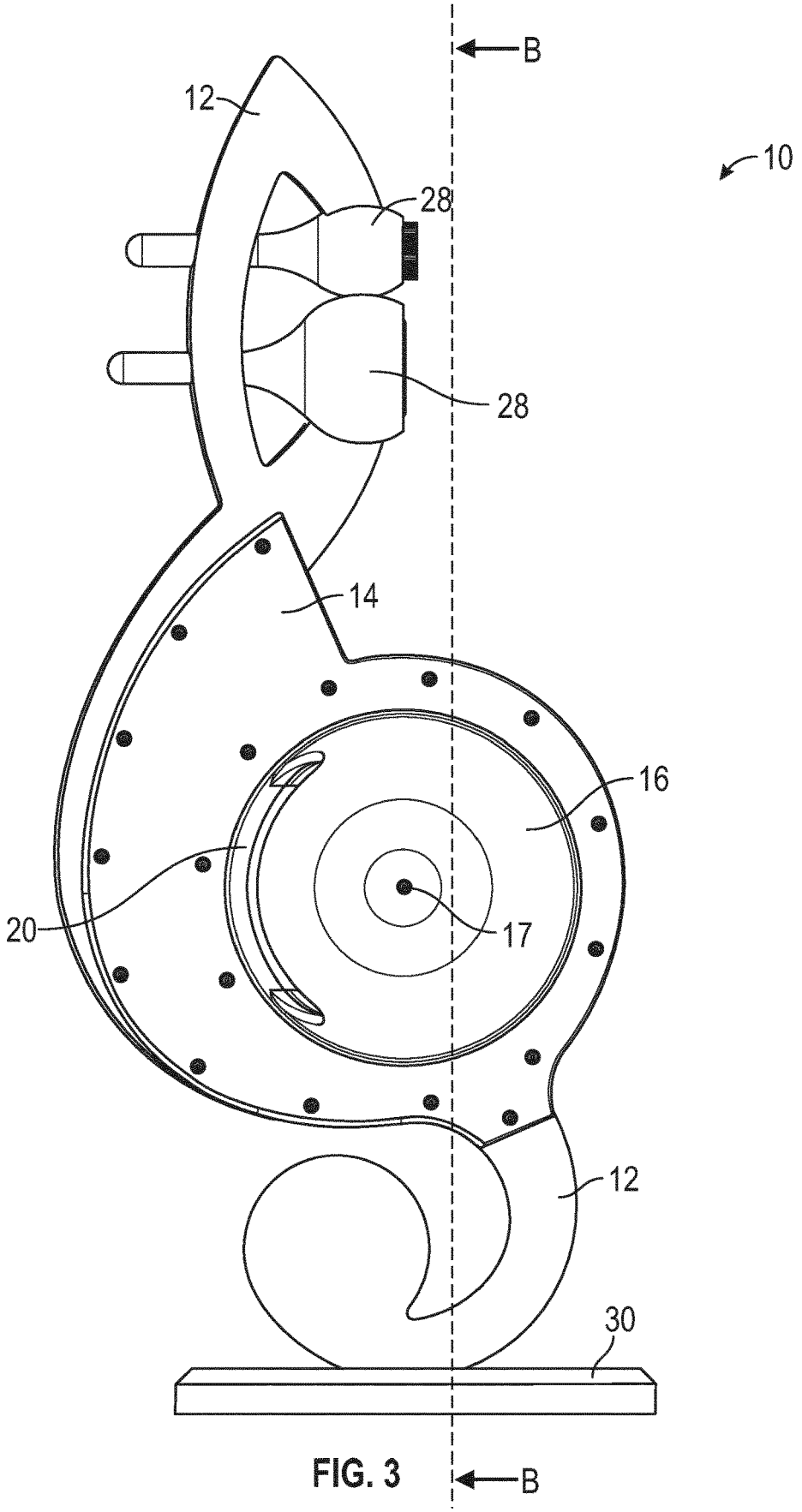
FIG. 3 shows a side view of the speaker system.

FIG. 3 shows a side view of the speaker system 10. The illustration shows a left side of the loudspeaker system 10 and clearly illustrates the frame structure 12 extending above the hemispherical cups 16 and the intermediate resonance chamber for the arrangement of the funnel-shaped enclosures having the midrange driver and super-tweeter installed, and the frame structure extending below the hemispherical cups 16 and the intermediate resonance chamber. The opposed wall elements only extend partly the vertical extent of the frame structure 12, and together with the hemispherical cups 16 and a rear of the frame structure 12 generate the loudspeaker housing defining the resonance chamber.

Figure 4:
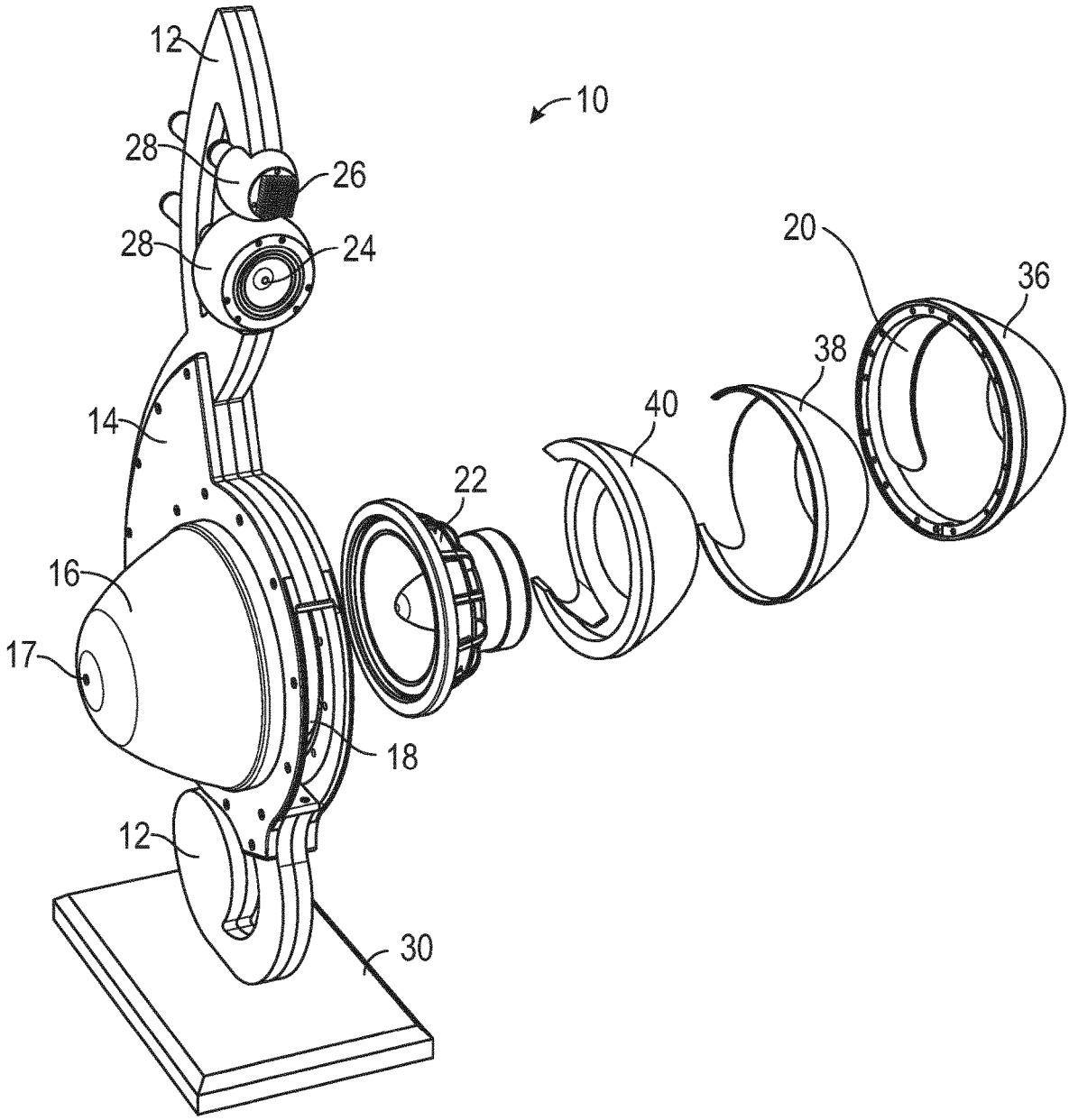
FIG. 4 shows a partly exploded perspective view of the speaker system.

FIG. 4 shows a partly exploded perspective view of the speaker system 10. In the illustration, one side of the loudspeaker system 10 is exploded and illustrates the loudspeaker driver 22 and the hemispherical cup having a layered construction comprising an outer layer 36, an intermediate layer 38, and an inner layer 40 for facing the loudspeaker driver. The outer layer 36, which is preferable made of wood, defines the entire opening area of the rear port 20, and the intermediate layer 38 and the inner layer partly defining the opening area of the rear port.

Figure 5:
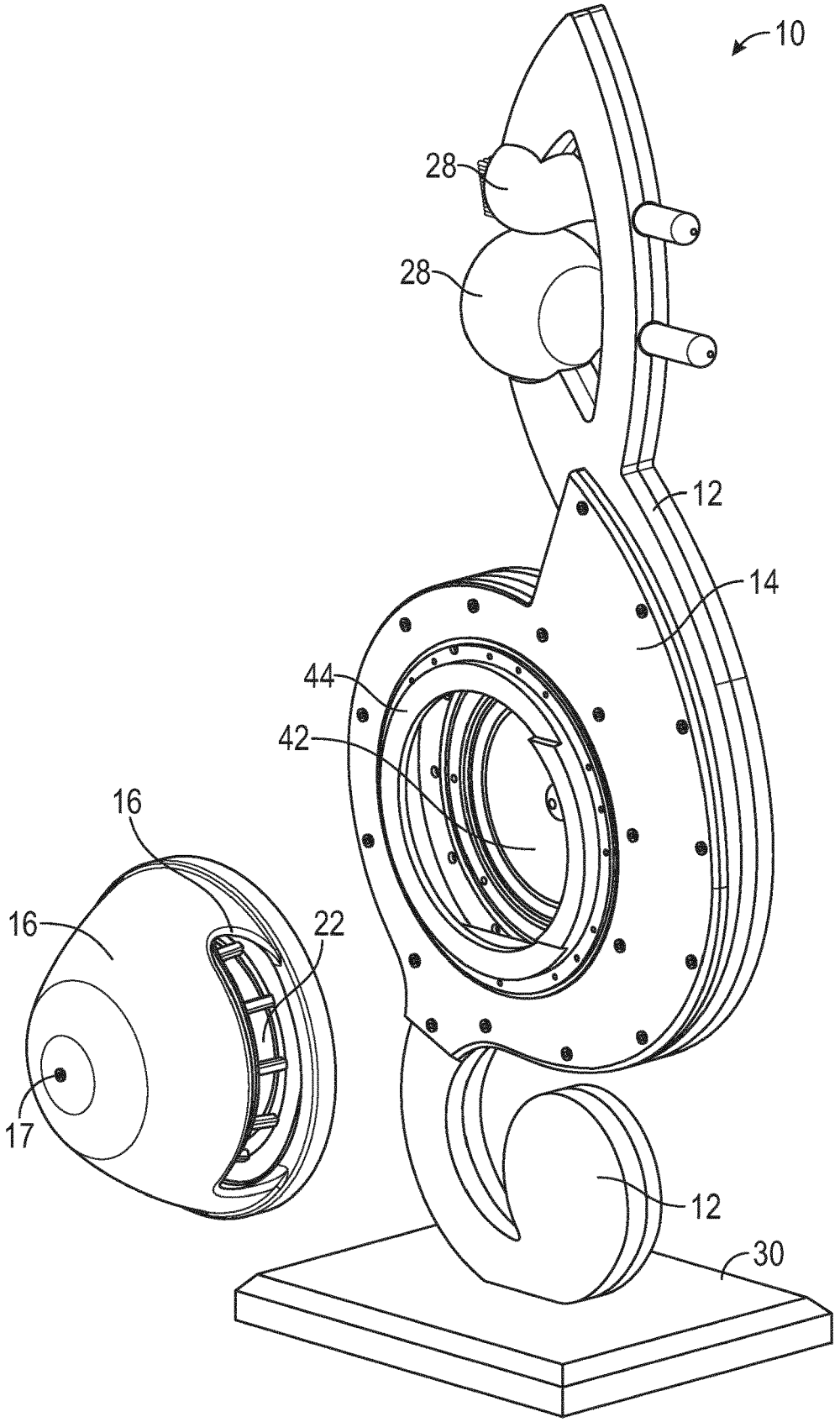
FIG. 5 shows a perspective view of the loudspeaker system, having the left hemispherical cup dismounted.

FIG. 5 shows a perspective view of the loudspeaker system 10, having one hemispherical cup 16 dismounted. The loudspeaker driver 22 is arranged within the hemispherical cup and connected thereto via fastening means 17 extending through the cup and into the magnet (not shown) of the loudspeaker driver 22.

The mounting ring 44 comprises an array of circumferential mounting holes for mounting the hemispherical cup 16 via suitable connecting means, such as screws (not shown), to the mounting ring 44. The mounting ring 44 further comprises a circumferential abutment flange for engaging the circumferential outer side surface of an opening in the wall element 14 and an inner circumferential flange (not shown) for abutting an inner edge surface of the opening in the wall element 14.

Between the loudspeaker drivers 22, connecting means 46 (shown in FIG. 8) are arranged for connecting the phase plug 48 of each loudspeaker driver 22. Each loud speaker driver 22 is hereby only connected to the hemispherical cup and the opposed loudspeaker driver and only abuts the mounting ring via an air-sealed rubber gasket (not shown), which may be arranged as an integral part of the loudspeaker driver 22.

Figure 6:
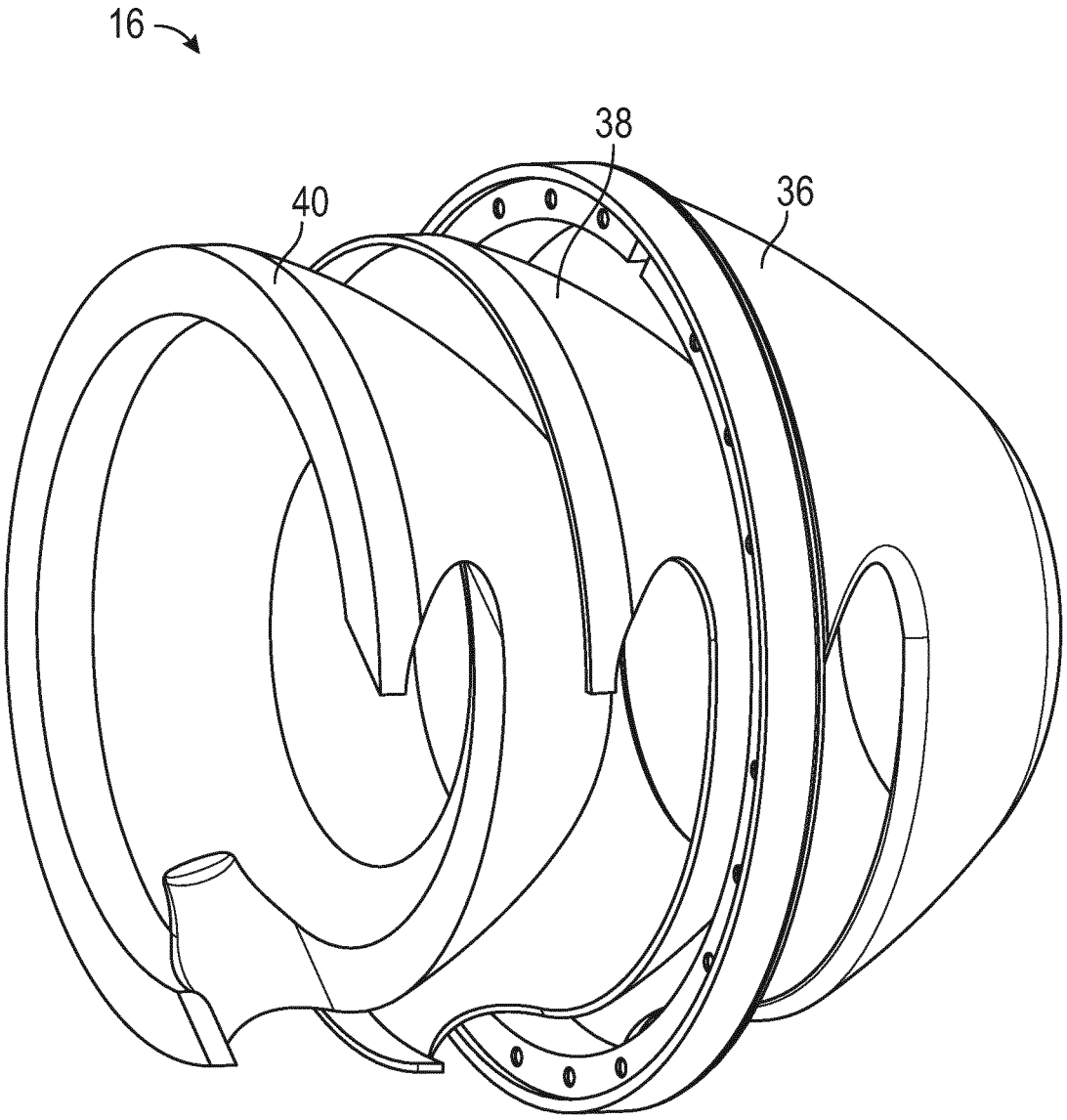
FIG. 6 shows an exploded perspective view of a hemispherical cup.
Figure 7:
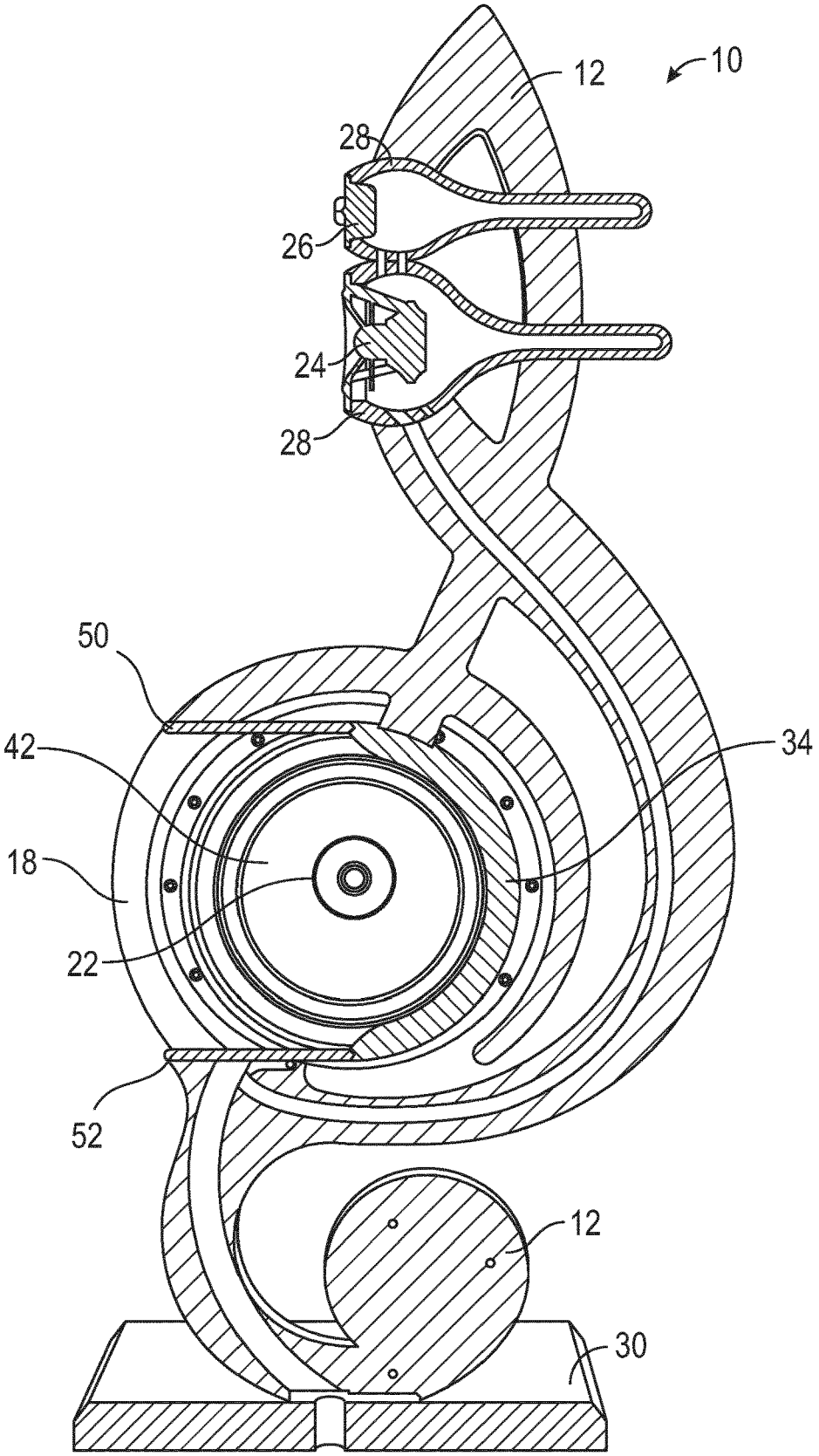
FIG. 7 shows a sectional side view of the speaker system along line A-A of FIG. 2.

FIG. 6 shows an exploded perspective view of a hemispherical cup 16. The hemispherical cup 16 is illustrated with an outer layer 36, preferably of wood, an intermediate layer 38, which preferably comprises a synthetic rubber, and an inner layer 40 of sound absorbing material, such as a syntactic foam. The three layers are preferably glued together by a suitable adhesive to act as constraint-layer damping, and an inner flange of the outer layer 36 of the hemispherical cup 16 is illustrated having mounting holes for connecting to the mounting ring 44 via fastening means, such as e.g. screws FIG. 7 shows a sectional side view of the speaker system 10 along line A-A of FIG. 2. The illustration shows a view of the resonance chamber 42 towards the front of one of the loudspeaker drivers 22. The figure clearly illustrates that the resonance chamber 42 is open at the front port 18 and delimited in an upper direction by a resonance chamber upper wall 50 and in a lower direction by a resonance chamber lower wall 52. A C-shaped element 34 is arranged at the back of the resonance chamber furthest away from the front port 18. The C-shaped element 34 delimits the resonance chamber 42 in a rearwards direction and is interposed between the front faces of the two opposed loudspeaker drivers 22, hereby reducing the overall volume of the resonance chamber 42. FIG. 7 further illustrates a cross section of the midrange driver 24 and the super-tweeter 26 being arranged within the funnel-shaped sealed enclosures 28, which are arranged as a spherical support extending into a closed tube-shape, extending in the rear direction of the loudspeaker system 10. The enclosures 28 extend through holes in the rear of the frame 12 and rest inside the hole in a vibration damping material, such as neoprene or silicon sheet. Likewise, the front of the enclosures 28 extends through the front of the frame 12, resting in a vibration damping material, such as neoprene or silicon sheet.

Figure 8:
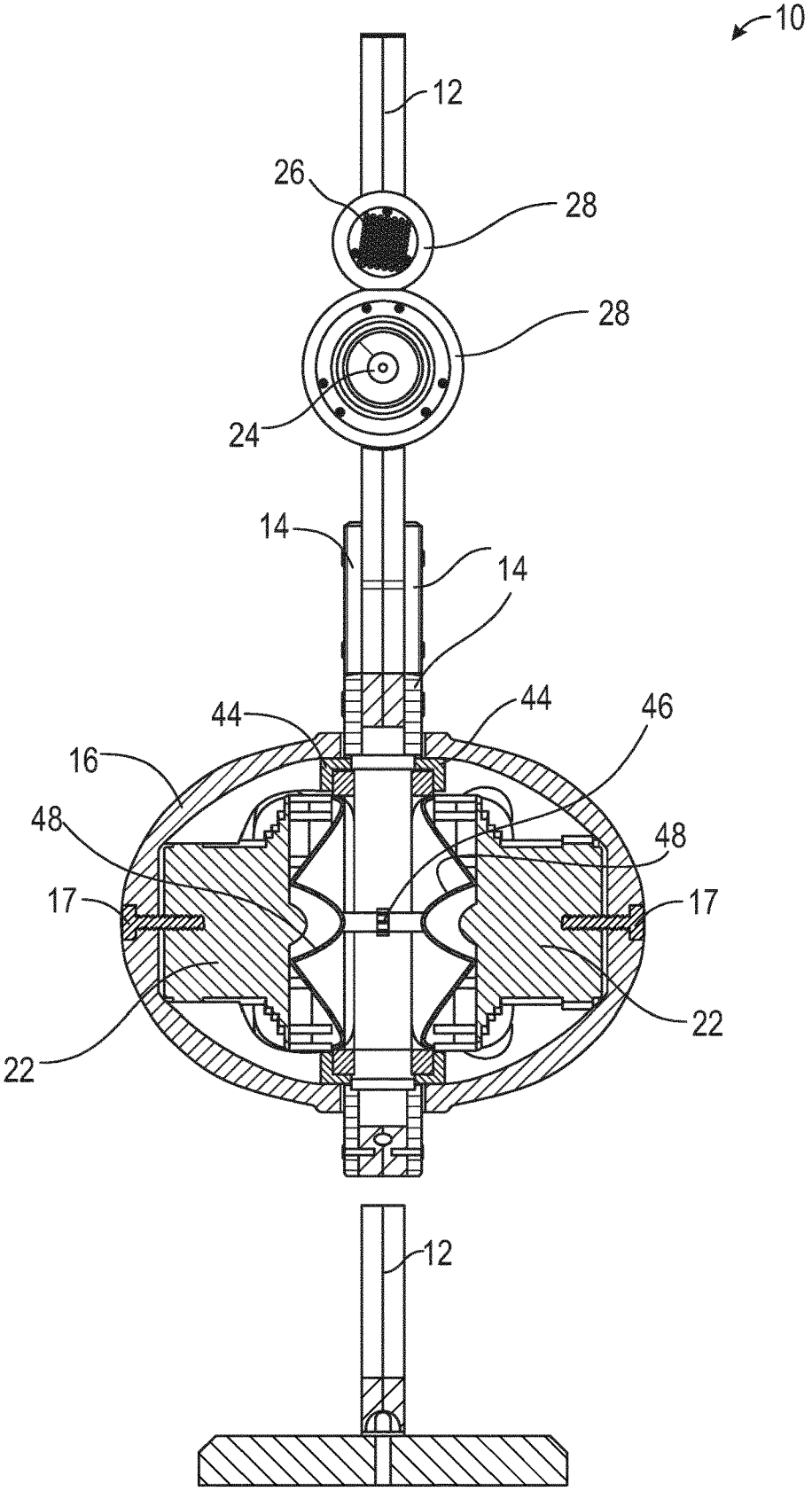
FIG. 8 shows a sectional side view of the speaker system along line B-B of FIG. 3.

FIG. 8 shows a sectional front view of the speaker system along line B-B of FIG. 3. The figure illustrates the arrangement of the loudspeaker drivers 22 inside the hemispherical cups 16. Each loudspeaker driver 22 is only connected to the loudspeaker system via fastening means 17, such as screws or bolts, extending through the hemispherical cups and into the magnet of the loudspeaker driver and via connecting means 46 arranged for interconnecting the phase plug of each loudspeaker driver 22. Hereby, the loudspeaker drivers 22 are arranged "floating" through the mounting ring 44, and only being in abutment thereto, preferably via an intermediate rubber seal.

The connecting means 46 comprises a threaded rod and a nut arrangement, where a threaded rod is connected to one of the loudspeaker drivers and a rod with a nut is connected to the other one of the loudspeaker drivers, whereupon connection, the two opposed loudspeaker drivers 22 are connected into a single physical system where the equal and opposite vibration motion energy induced by driver piston and coil is cancelled out.

In the following is given a list of reference signs that are used in the detailed description of the invention and the drawings referred to in the detailed description of the invention.

10. Audio loudspeaker system
12. Frame structure
12A. First frame structure element
12B. Second frame structure element
14. Wall element
16. Hemispherical cup
17. Fastening means
18. Front port
20. Rear port
22. Loudspeaker driver
24. Midrange driver
26. Super-tweeter
28. Funnel-shaped enclosure
30. Speaker foot
32. Fastening means
34. C-shaped element
36. Outer layer
38. Intermediate layer
40. Inner layer
42. Resonance chamber
44. Mounting ring
46. Driver connecting means
48. Phase plug
50. Resonance chamber upper wall
52. Resonance chamber lower wall

The invention claimed is:

1. An audio loudspeaker system for reproducing frequencies between 16 Hz and 700 Hz, comprising a loudspeaker housing defining an inner resonance chamber and at least two loudspeaker drivers arranged in said housing and having front faces arranged facing each other in an opposed manner, said housing comprising vertical first and second opposed and parallel wall elements arranged with a distance approximately defining a width of said resonance chamber, where each wall element comprises first and second side surfaces and a circumferential edge surface, where part of said circumferential edge surfaces defines an upper edge surface, a lower edge surface, a front edge surface facing a front of said loudspeaker system, and a rear edge surface facing a rear of said loudspeaker system, said first side surface of said first and said second opposed wall elements constituting an inner surface of said housing and partly defining an enclosure of said resonance chamber, and said second side surfaces of said first and said second wall elements constituting a first and second exterior side surface of said audio loudspeaker system, said housing further comprising a frame structure being arranged between said first and second wall elements and at a peripheral circumference thereof, said frame structure partly defining an enclosure of said resonance chamber, said loudspeaker drivers being arranged on said second side surfaces of said first and said second wall elements, respectively, and said front faces of said loudspeaker drivers facing said resonance chamber and facing each other, said opposed loudspeaker drivers each further comprising a substantially hemispherical cup arranged on said second side surfaces of said first and said second wall elements, and enclosing said loudspeaker drivers in a close manner.

2. The audio loudspeaker system according to claim 1, wherein said hemispherical cups comprise a layered construction having and outer surface layer.

3. The audio loudspeaker system according to claim 2, wherein said hemispherical cups further comprises an intermediate layer between said outer and said inner layer, said intermediate layer comprising a synthetic rubber.

4. The audio loudspeaker system according to claim 3, wherein the synthetic rubber is a butyl rubber.

5. The audio loudspeaker system according to claim 2, wherein said sound absorbing material comprises a cement-based syntactic foam.

6. The audio loudspeaker system according to claim 2, wherein the outer surface layer comprises hardwood, ceramic, or plastic, and at least one inner layer of sound absorbing material.

7. The audio loudspeaker system according to claim 6, wherein the sound absorbing material is a syntactic foam.

8. The audio loudspeaker system according to claim 1, wherein said frame structure comprises at least one open port facing said front of said loudspeaker system.

9. The audio loudspeaker system according to claim 1, wherein each of said hemispherical cups comprises at least one open rear port facing said rear of said loudspeaker system.

10. The audio loudspeaker system according to claim 9, wherein said open rear port defines an open area of approximate ¼ of the area of a piston of each of said loudspeaker drivers.

11. The audio loudspeaker system according to claim 1, wherein said opposed loudspeaker drivers are woofers for operating in phase.

12. The audio loudspeaker system according to claim 1, wherein said frame structure extends above said opposed loudspeaker drivers and said frame structure further comprises at least one midrange driver and/or at least one super-tweeter driver, each arranged within a funnel-shaped enclosure, arranged as a spherical support extending into a closed tube-shape and having inner conical shape, extending in the rear direction of the loudspeaker system.

13. The audio loudspeaker system according to claim 12, wherein each of said funnel-shaped enclosures comprises a vibration damping material.

14. The audio loudspeaker system according to claim 13, wherein the vibration damping material is a synthetic or natural wool material.

15. The audio loudspeaker system according to claim 1, wherein said vertical first and second, opposed and parallel wall elements comprise an acrylic sheet material.

16. The audio loudspeaker system according to claim 1, said loudspeaker system further comprising driver connection means extending through said resonance chamber and arranged for interconnecting the phase plug of each loudspeaker driver, said loudspeaker drivers having driver magnets at a rear end thereof, and being connected to said hemispherical cups via fastening means extending through said hemispherical cup and into said magnet, hereby arranging the loudspeaker drivers connected and suspended between said hemispherical cups.

17. The audio loudspeaker system according to claim 16, wherein the fastening means is a bolt.

18. The audio loudspeaker system according to claim 1, wherein said speaker system comprises an intermediate C-shaped element arranged within said inner resonance chamber between said loudspeaker drivers and at a peripheral circumference of said driver piston, hereby limiting said inner volume of said resonance chamber between said loudspeaker drivers.

19. The audio loudspeaker system according to claim 1, wherein said frame structure is having the shape of a treble clef.

20. The audio loudspeaker system according to claim 1, wherein said frame structure is any musical symbol or non-musical structure.

* * * * *